United States Patent [19]

Whitten

[11] Patent Number: 4,737,677

[45] Date of Patent: Apr. 12, 1988

[54] LINEAR SODIUM LAMP ARC TUBE CENTERING MEANS

[75] Inventor: Robert C. Whitten, Pittsfield, N.H.

[73] Assignee: GTE Products Corporation, Danvers, Mass.

[21] Appl. No.: 928,731

[22] Filed: Nov. 7, 1986

Related U.S. Application Data

[63] Continuation of Ser. No. 676,999, Nov. 30, 1984, abandoned.

[51] Int. Cl.[4] ..... H01J 61/073; H01J 61/34

[52] U.S. Cl. ..... 313/25; 313/631; 313/634; 313/253

[58] Field of Search ..... 313/25, 253, 631, 634

[56] References Cited

U.S. PATENT DOCUMENTS

| | | | |
|---|---|---|---|
| 3,662,203 | 5/1972 | Kuhl et al. | 313/25 |
| 3,882,346 | 5/1975 | Mc Vey | 313/253 |
| 3,932,781 | 1/1976 | Peeters et al. | 313/25 |
| 4,254,355 | 3/1981 | Taylor | 313/25 |
| 4,401,913 | 8/1983 | Koza et al. | 313/25 |

*Primary Examiner*—David K. Moore
*Assistant Examiner*—K. Wieder
*Attorney, Agent, or Firm*—José W. Jimenez; Joseph S. Romanow

[57] ABSTRACT

A high pressure sodium vapor discharge lamp of the type having a discharge tube with a feed-through tube and an internal electrode at each end of the tube. An outer envelope encompasses the arc tube and there is an arc tube centering means disposed within the outer envelope and electrically coupled to the arc tube. The arc tube centering means is comprised of a geometric configuration which compensates for thermal expansion differences between the arc tube and the outer envelope during lamp sealing and, more importantly, lamp operation. The arc tube centering means includes a pair of offset lead wires, at least one of which has a twisted loop disposed along its length. The offset lead wires are preferably made of niobium.

14 Claims, 1 Drawing Sheet

LINEAR SODIUM LAMP ARC TUBE CENTERING MEANS

This is a continuation of application Ser. No. 676,999, filed Nov. 30, 1984 and now abandoned.

TECHNICAL FIELD

The present invention relates to linear type sodium lamps and in particular to means for centering the arc tube longitudinally within the outer envelope.

BACKGROUND

Several types of mountings and means for centering the arc discharge tube within an outer envelope in an arc discharge lamp are well known in the art. Examples are illustrated in U.S. Pat. Nos. 3,662,203 (Kuhl et al), 3,932,781 (Peeters et al) and 4,401,913 (Koza et al). In Kuhl et al and Peeters et al, means for centering the arc discharge tube also serve as current supply members for the electrodes of the arc discharge tube. In both embodiments, the current supply members or expansion lead-ins are made of molybdenum. In Kuhl et al, the lead-in members are "S" shaped; and in Peeters et al, the lead-in members are spiral shaped. In both inventions, the arc tube centering means is connected to the arc tube and to the outer lead assemblies located at each end of the lamp's outer envelope.

The aforementioned patents do not address the difficulties encountered during lamp sealing in attempting to center the arc tube within the outer envelope while maintaining the integrity of the seal in the outer lead assemblies. In addition, the problem of premature failure of an arc tube centering means contained within the lamp due to fatigue, caused by constant compensation for the thermal expansion of an arc tube with respect to the outer envelope, has so far remained unsolved.

Providing an effective and lasting electrical connection between the arc tube centering means and the arc discharge tube has also been a difficult problem. In order to center the arc tube, some tension must be applied to the outer lead assemblies. As heat is applied during lamp sealing, the coiled expansion leads expand and tend to move the molybdenum sealing ribbon, located within the outer lead assembly, out of alignment and make a poor seal. In addition, the molybdenum expansion leads may not make very good welds with the niobium feed-through tubes of the arc tube. Since niobium is soft and has no spring temper, it was believed that effective expansion leads could not be made from such a material. Finally, during heat sealing the coiled expansion leads expand and tend to move the arc tube out of its center position.

Arc tube centering means for an arc discharge lamp which improves the integrity of the seal located at the outer lead assembly and which improves the integrity of the electrical connection between the centering means and the arc tube would constitute a significant advancement in the art. Such a lamp would be an even further advancement if it could be easily manufactured, would prolong the life of the arc discharge lamp, and prevent premature failure of the arc tube centering means due to fatigue.

SUMMARY OF THE INVENTION

Therefore, it is a primary object of this invention to enhance the art of arc discharge lamps and particularly to provide an improved sodium lamp having improved means for centering and electrically connecting the arc discharge tube within an outer glass envelope.

It is another object of the invention to provide a linear type sodium lamp having improved seals within the outer lead assemblies located at each end of the outer glass envelope.

It is still another object of the invention to provide such a lamp as defined above which has an improved electrical connection between the arc tube centering means and the arc discharge tube.

It is a further object of the invention to provide arc tube centering means which permits thermal expansion of the arc longitudinally tube with respect to the outer envelope without leading to premature failure of arc tube centering means due to fatigue.

In accordance with one aspect of the present invention, there is provided an improved high pressure sodium vapor discharge lamp of the type having an arc discharge tube with a feed-through tube and an internal electrode at each end of the tube. The arc discharge lamp further includes an outer envelope encompassing the arc tube, spacer means centering the arc tube in the outer envelope, arc tube centering means disposed within the outer envelope and electrically coupled to the arc tube and an outer lead assembly disposed at each end of the outer envelope with the arc tube centering means forming part thereof. The improvement of the arc discharge lamp lies within the arc tube centering means which comprises a geometric configuration that compensates for thermal expansion differences between the outer envelope and arc tube centering means during lamp sealing and, more importantly, lamp operation. The improved arc tube centering means will improve the integrity of a seal at each of the outer lead assemblies and will prevent premature failure of the arc tube centering means due to fatigue.

BEST MODE FOR CARRYING OUT THE INVENTION

For a better understanding of the present invention together with other and further objects, advantages and capabilities thereof, reference is made to the following disclosure and appended claims in conjunction with the above described drawings.

Figure 1:
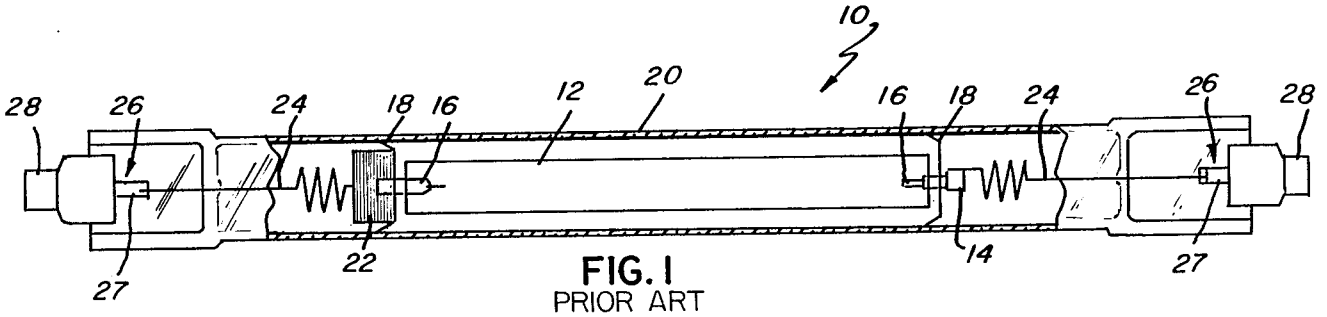
FIG. 1 PRIOR ART
FIG. 1 illustrates one example of a prior art linear type sodium lamp.

With reference now to the drawings, there is shown in FIG. 1 one example of a linear type sodium lamp 10, found in the prior art, for use in a lamp unit. Lamp 10 includes an arc tube 12 having feed-through tubes 14 located at each end of arc tube 12, and electrodes 16 located within arc tube 12. Lamp 10 further includes spacer means 18, which provides resilient support for arc tube 12 and prevents arc tube 12 from making contact with outer envelope 20, which encompasses arc tube 12. Lamp 10 further includes a ring of strip getter material 22 and two molybdenum expansion leads 24 disposed on either side of arc tube 12. Finally, lamp 10 has a pair of outer lead assemblies 26, each of which is disposed at either end of outer envelope 20, which include a molybdenum ribbon 27 and a molybdenum wire from lead 24. Sealing of the lamp is done in a conventional manner, press sealing first one end of the lamp 10 and then the other. Bases 28 are cemented to each end of lamp 10.

Figure 2:
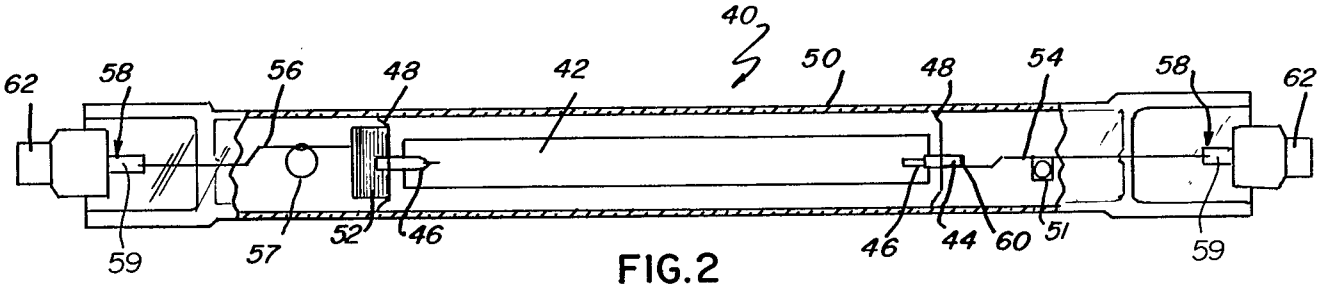
FIG. 2 illustrates one embodiment of the linear type sodium lamp made in accordance with the teachings of the present invention.

Referring now to FIG. 2, there is shown a linear type, high pressure sodium lamp 40 made in accordance with the teachings of the present invention. Lamp 40 includes an arc discharge tube 42 having feed through tubes 44 and electrodes 46 located at each end. Lamp 40 further includes spacer means 48, which are separate resilient mechanisms located on either side of arc tube 42, which resiliently support arc tube 42 relative to an outer envelope 50. Spacer means 48 includes a pair of disks having a plurality of supports located at the periphery of each of the disks. Outer envelope 50 may be made of lead borosilicate glass or quartz. Lamp 40 includes a ring of strip getter material 52 (optionally another getter may be included as tab 51) and arc tube centering means, which is comprised of offset lead wires 54 and 56. The offset lead wires also supply current to the arc tube. Arc tube centering means form electrical connections at 60 and at outer lead assemblies 58. Each outer lead assembly 58 includes a molybdenum ribbon 59 and one of the offset lead wires. Finally, bases 62 are cemented onto each end of outer envelope 50.

The prior art lamp illustrated in FIG. 1 has exhibited problems which the lamp of the present invention solves. For example, arc tube 12 may shift from its center position during lamp sealing due to expansion, caused by the heat, in expansion leads 24 which tend to move the arc tube out of its position. In addition, poor welds can result between molybdenum expansion leads 24 and niobium feed-through tubes 14 of arc tube 12. It had been thought that since niobium is soft and has no spring temper, it could not be used to make effective expansion leads.

Poor seals in outer lead assemblies 26 are another unsolved problem that have resulted in prior art lamps, such as lamp 10, during the sealing process. This occurs as follows. In centering the arc tube, some tension is applied to the outer lead assemblies. As heat is applied for sealing, the coiled expansion leads expand and tend to move the molybdenum sealing ribbon 27 out of alignment, thereby resulting in a poor seal. In addition, premature failure of arc tube centering means due to fatigue has also been a problem in these lamps. During lamp operation, the arc tube centering means constantly compensates for the thermal expansion of the arc tube with respect to the outer envelope. Such constant wear on centering means has lead to fatigue and ultimate failure.

The lamp of the present invention provides means for centering an arc discharge tube within its outer envelope while improving the seal at the outer lead assembly, improving the electrical connection between the arc tube centering means and the feed through tubes of the arc discharge tube, and preventing premature failure of arc tube centering means due to fatigue. The arc tube centering means of the present invention is comprised of a geometric configuration which compensates for thermal expansion differences between the outer envelope and the arc tube centering means during lamp sealing and, more importantly, lamp operation. In particular, arc tube centering means is comprised of offset lead wires 54 and 56, as illustrated in FIG. 2. At least one of the offset wires has the geometric configuration disposed along the length of the wire.

In this particular embodiment, the geometric configuration consists of a twisted loop 57. Lead wires 54 and 56 are said to be offset since they are connected to feed-through tubes 44 and 46 in the manner which is off center the axis running along the length of arc tube 42. During sealing of the lamp, and lamp operation, loop 57 will expand and distribute the bending force over the length of lead wire 56 and lead wire 54. Such a distribution of force ensures that pressure is not exerted to move molybdenum ribbon 59, contained within outer lead assembly 58, during the sealing process. With the addition of loop 57, the sealing ribbons can now be positioned and the arc tube centered prior to sealing by applying sufficient tension. Once positioned, the heat applied during sealing will not result in a compressive force in the offset wires which will disturb the sealing ribbon or the arc tube. In addition, the constant distribution by loop 57 of the force exerted on arc tube centering means during lamp operation, due to the thermal expansion of the arc tube, along the length of the centering means should prevent premature failure of centering means caused by fatigue. In this particular embodiment feed-through tubes 44 and 46 and offset lead wires 54 and 56 are formed from niobium.

The arc tube centering means of the present invention also improves the integrity of the electrical connection between arc tube centering means and the arc discharge tube itself. In the present invention, the arc tube centering means is formed from a material having a coefficient of thermal expansion substantially similar to the material forming the feed-through tubes. Such a matching of expansion coefficients serves to improve the integrity of the electrical coupling between the centering means and the arc tube. For example, feed-through tubes 44 and 46 and offset lead wires 54 and 56 are all formed from niobium. The molybdenum expansion leads of the prior art sodium lamps may not make good electrical connections or welds with the niobium tubes of the arc tubes. In addition, niobium was not used before to make expansion leads because it was thought that effective expansion leads could not be made from a material that is soft and has no spring temper. In the present invention, the replacement of molybdenum expansion leads with the niobium offset wire leads has eliminated the welding problem.

Thus, there has been shown and described an improved arc discharge lamp including arc tube centering means which serves to properly center the arc tube during the lamp sealing and lamp operation, improves the seal at the outer lead assemblies located at opposite ends of the lamp, and improves the integrity of the electrical connection between the arc tube centering means and the arc discharge tube. In particular, arc tube centering means is comprised of a pair of offset lead wires having a geometric configuration which compensates for thermal expansion differences between the outer envelope and the arc tube during lamp sealing and, more importantly, lamp operation. The geometric configuration is disposed along the length of one of the offset lead wires and consists of a twisted loop. The arc tube centering means and feed through tubes are preferably formed from niobium. The arc tube centering means made in accordance with the teachings of the present invention are preferably incorporated in a linear type sodium lamp of the 250-watt or 400-watt type, but are not limited to such lamps.

EXAMPLE

In accordance with one embodiment of the invention, a 250-watt lamp operates on a voltage of about 100 lamp volts (rms) with a current drop of about 3.0 amps. The outer envelope has a bulb size of T-7 and is made from quartz. The arc tube is made from polycrystalline aluminum oxide and has a length of about 87 millimeters and is filled with an xenon gas. The offset wires are made of niobium and each have an average length of about 55 millimeters and have a diameter of about 0.03 inch. The twisted loop in one of the offset wires has at least a single twist in it.

While there have been shown and described what are at present considered the preferred embodiments of the invention, it will be obvious to those skilled in the art that various changes and modifications may be made therein without departing from the scope of the invention as defined by the appended claims.

What is claimed is:

1. An improved high-pressure sodium vapor discharge lamp having an outer envelope elongated longitudinally along a central axis, said outer envelope having two opposed ends and enclosing an arc discharge tube with a feed-through tube and an internal electrode in each end of said outer envelope, spacer means centering said arc tube about said central axis within said outer envelope, arc tube centering means disposed within said outer envelope and electrically coupled to said arc tube, an outer lead assembly including a press seal disposed at each end of said outer envelope with said arc tube centering means forming part thereof, said end seals being subject to fatigue caused by thermal expansion and contraction of said arc tube, the improvement wherein said arc tube centering means comprises:

a pair of offset lead wires disposed within said outer envelope, each of said offset lead wires being offset from said central axis, at least one of said offset lead wires having a geometric configuration disposed along the length thereof, said geometric configuration having the ability to expand and contract longitudinally along said central axis such that said arc tube remains centered longitudinally within said outer envelope and said end seals are not fatigued by the thermal expansion and contraction of said arc tube during manufacture or operation of said lamp, each of said lead wires being coupled to said arc tube and said outer lead assembly, whereby said arc tube centering means improves the integrity of said seals at each end of said outer envelope.

2. The improvement according to claim 1 wherein said geometric configuration of said offset lead wire consists of a twisted loop.

3. The improvement according to claim 3 wherein said arc tube centering means is formed from a material having a coefficient of thermal expansion substantially similar to the material forming said feed-through tubes, thereby improving the integrity of said electrical coupling between said centering means and said arc tube.

4. The improvement according to claim 3 wherein said material of said feed-through tubes is niobium.

5. The improvement according to claim 4 wherein said pair of offset wires is formed from niobium.

6. The improvement according to claim 1 wherein said arc tube centering means if formed from a material having a coefficient of thermal expansion substantially similar to the material forming said feed-through tubes, thereby improving the integrity of said electrical coupling between said centering means and said arc tube.

7. The improvement according to claim 6 wherein said arc tube centering means includes a pair of offset lead wires.

8. The improvement according to claim 7 wherein said electrical coupling between said centering means and said arc tube is a weld between one of said offset lead wires and one of said feed-through tubes.

9. The improvement according to claim 8 wherein said material of said feed-through tubes is niobium.

10. The improvement according to claim 9 wherein said pair of offset lead wires is formed from niobium.

11. The improvement according to claim 10 wherein at least one of said offset lead wires has said geometric configuration disposed along the length of said wire.

12. The improvement according to claim 11 wherein said geometric configuration of said offset lead wire consists of a twisted loop.

13. The improvement according to claim 1 wherein said spacer means includes a pair of disks having a plurality of supports located at the periphery of each of said disks, each of said disks bounding said arc tube.

14. A lamp as described in claim 2 wherein said twisted loop is positioned substantially in a plane including said central axis.

* * * * *